US009406225B2

(12) United States Patent
Finnis et al.

(10) Patent No.: US 9,406,225 B2
(45) Date of Patent: Aug. 2, 2016

(54) TRAFFIC DATA SERVICES WITHOUT NAVIGATION SYSTEM

(71) Applicant: Sirius XM Radio Inc., New York, NY (US)

(72) Inventors: Sven Mark Finnis, Crownsville, MD (US); William Carl Stumphauzer, II, South Lyon, MI (US); John Dombrowski, Willis, MI (US); Naresh Coppisetti, Pennington, NJ (US); David Birks, New Egypt, NJ (US)

(73) Assignee: Sirius XM Radio Inc., New York, NY (US)

( * ) Notice: Subject to any disclaimer, the term of this patent is extended or adjusted under 35 U.S.C. 154(b) by 0 days.

(21) Appl. No.: 14/518,367

(22) Filed: Oct. 20, 2014

(65) Prior Publication Data

US 2015/0112579 A1 Apr. 23, 2015

Related U.S. Application Data

(63) Continuation of application No. 13/793,566, filed on Mar. 11, 2013, now Pat. No. 8,868,321, which is a continuation of application No. 12/799,898, filed on May 3, 2010, now Pat. No. 8,396,651.

(60) Provisional application No. 61/174,955, filed on May 1, 2009.

(51) Int. Cl.

| | |
|---|---|
| ***G08G 1/00*** | (2006.01) |
| ***G08G 1/0962*** | (2006.01) |
| ***G08G 1/0969*** | (2006.01) |

(52) U.S. Cl.
CPC ..... *G08G 1/00* (2013.01); *G08G 1/0962* (2013.01); *G08G 1/0969* (2013.01)

(58) Field of Classification Search
CPC ..... G08G 1/00; G08G 1/0962; G08G 1/0969
See application file for complete search history.

(56) References Cited

U.S. PATENT DOCUMENTS

| | | | | |
|---|---|---|---|---|
| 7,940,742 | B2 * | 5/2011 | Lee et al. | 370/349 |
| 8,751,152 | B2 * | 6/2014 | Geelen et al. | 701/410 |
| 2008/0133126 | A1 | 6/2008 | Dupray | |
| 2008/0275637 | A1 | 11/2008 | Kim et al. | |
| 2009/0048750 | A1 | 2/2009 | Breed | |
| 2009/0058679 | A1 * | 3/2009 | Lauterbach et al. | 340/905 |
| 2011/0187558 | A1 * | 8/2011 | Serex | 340/905 |

OTHER PUBLICATIONS

International Search Report Application No. PCT/US2014/01319, Date of Mailing Jun. 24, 2014.

* cited by examiner

*Primary Examiner* — Faye M Fleming
(74) *Attorney, Agent, or Firm* — Kramer Levin Naftalis & Frankel LLP

(57) ABSTRACT

A non-navigation data system for providing traffic data service in a mobile environment can include a data decoder for decoding a digital data stream from a digital audio radio transmission source, location determining means (such as GPS or cellular location determining schemes) for determining a current location of a mobile receiver receiving the digital data stream, a display for displaying traffic data corresponding to the current location, and a plurality of static maps wherein the traffic data corresponding to the current location is overlaid at least over a portion of the static maps.

20 Claims, 16 Drawing Sheets

Exemplary Split Screen View

Exemplary base image – user sees a one glance snapshot of the entire market

Exemplary zoomed out image of center – user sees higher resolution traffic image of the city center.

User sees higher resolution traffic image when traveling to/from north/west/northwest of the city.

User sees higher resolution traffic image when traveling to/from east/north/northeast of the city.

User sees higher resolution traffic image when traveling to/from south/west/southwest of the city.

Exemplary Day/Night Views

Exemplary Split Screen View

Shown with flow dots

Shown with flow lines

Austin, TX PNG file – heavy traffic

Austin, TX PNG file – default condition

Example showing congestion "incidents", which hide the colored flow data

TRAFFIC DATA SERVICES WITHOUT NAVIGATION SYSTEM

CROSS-REFERENCE TO RELATED APPLICATIONS

This application is a continuation of U.S. application Ser. No. 13/793,566 filed Mar. 11, 2013 which claims the benefit of U.S. Non-Provisional patent application Ser. No. 12/799,321 entitled "TRAFFIC DATA SERVICES WITHOUT NAVIGATION SYSTEM", and filed on May 3, 2010 (Now U.S. Pat. No. 8,396,651 issued on Mar. 12, 2013), which claims the benefit of U.S. Provisional Patent Application No. 61/174,955 filed on May 1, 2009, the specifications of which are hereby incorporated herein by reference.

TECHNICAL FIELD

The present invention generally relates to systems and methods of providing traffic data services in an automotive mobile environment, and in particular to providing such services in such an environment that does not include (or require) a GPS-based navigation system.

BACKGROUND OF THE INVENTION

Satellite digital radio broadcasters, such as, for example, Sirius XM Radio Inc. ("Sirius XM"), currently offer well over a hundred channels of content over a large geographic footprint. A portion of that content can include data services that interoperate with existing GPS-based navigation services commonly available for use in automobiles, for example. Such data services can include, for example, traffic data, such as road obstructions, congestion, hazards due to weather, and other road conditions. For example, Sirius SXM has operated real time traffic data services for premium navigation systems since 2004. These services provide a subscriber with real-time traffic information, enabling a vehicle's navigation system or Personal Navigation Device ("PND") to display constantly refreshed and current traffic conditions. However, for the large portion of the existing and future markets that do not or will not have access to GPS-based navigation systems, these data services are useless.

In a typical satellite radio service configuration of approximately 100 channels or more, nearly 50 channels provide music with the remaining stations offering news, sports, talk and data. For example, the broadcast services provided by Sirius SXM Radio Inc. each include a satellite X-band uplink to two or more satellites which provide frequency translation to the S-band for re-transmission to radio receivers on earth within a coverage area. Radio frequency carriers from one of the satellites are also received by terrestrial repeaters. The content received at the repeaters is retransmitted at a different S-band carrier to the same radios that are within their respective coverage areas. These terrestrial repeaters facilitate reliable reception in geographic areas where geosynchronous satellite reception is obscured by tall buildings, hills or other natural obstructions, tunnels, or other obstructions. The signals transmitted by the satellites and the repeaters are received by satellite digital audio radio system ("SDARS") receivers which can be located in automobiles, in handheld units, or in stationary units for home or office use. The SDARS receivers are designed to receive one or both of the satellite signals and the signals from the terrestrial repeaters and dynamically combine or select one of the signals to output to a user.

Each SDARS receiver generally contains a unique Hardware Identification number (HWID), which is assigned during the manufacturing process. The HWID can be used by SDARS Service Providers to enable the receiver to receive, or disable the receiver from receiving, particular subscribed services such as music and talk programming. In addition, these subscribed services can include data services, such as, for example, weather and traffic data feeds or other custom data feeds. Such custom data feeds are typically uniquely enabled by the SDARS Service Provider for select subscriber groups.

Although existing telematics systems using cellular and Global Positioning System (GPS) technology, such as, for example, the General Motors On-Star system, currently track vehicles and provide services such as dispatching emergency road side assistance upon detection of certain detected events at the vehicle, no current system graphically provides enhanced data services independently of a navigation system, which typically requires additional memory and resources to operate.

Additionally, current navigation services store databases of maps and other data and rely on complicated navigational systems, routing engines, embedded map databases and other resources to provide their information to users, all of which adds complexity and cost.

What is needed in the art are systems and methods of providing traffic data services in an automotive environment without requiring, or being dependent upon, GPS-based navigation systems

SUMMARY OF THE INVENTION

In exemplary embodiments of the present invention, a suite of data services for non-navigation based head units can be provided that provide similar levels of functionality to GPS navigation-based systems. Such exemplary embodiments can, for example, provide traffic data services to a user without the need for navigational systems. In exemplary embodiments of the present invention, a system for providing traffic data services in an automotive mobile environment can include a data decoder for decoding a digital data stream from a digital audio transmission source, a location determining module for determining a current location of a mobile receiver receiving the digital data stream, a display for displaying traffic data corresponding to the current location, and a plurality of static maps wherein traffic data corresponding to the current location can be overlaid over all or a portion of the static maps. In exemplary embodiments of the present invention a method of providing traffic data services in an automotive mobile environment can include decoding a digital data stream from a digital audio transmission source, determining a current location of a mobile receiver receiving the digital data stream, displaying traffic data corresponding to the current location, and overlaying the traffic data corresponding to the current location over all or a portion of static maps corresponding to the then current location.

DETAILED DESCRIPTION OF THE INVENTION

Figure 1:
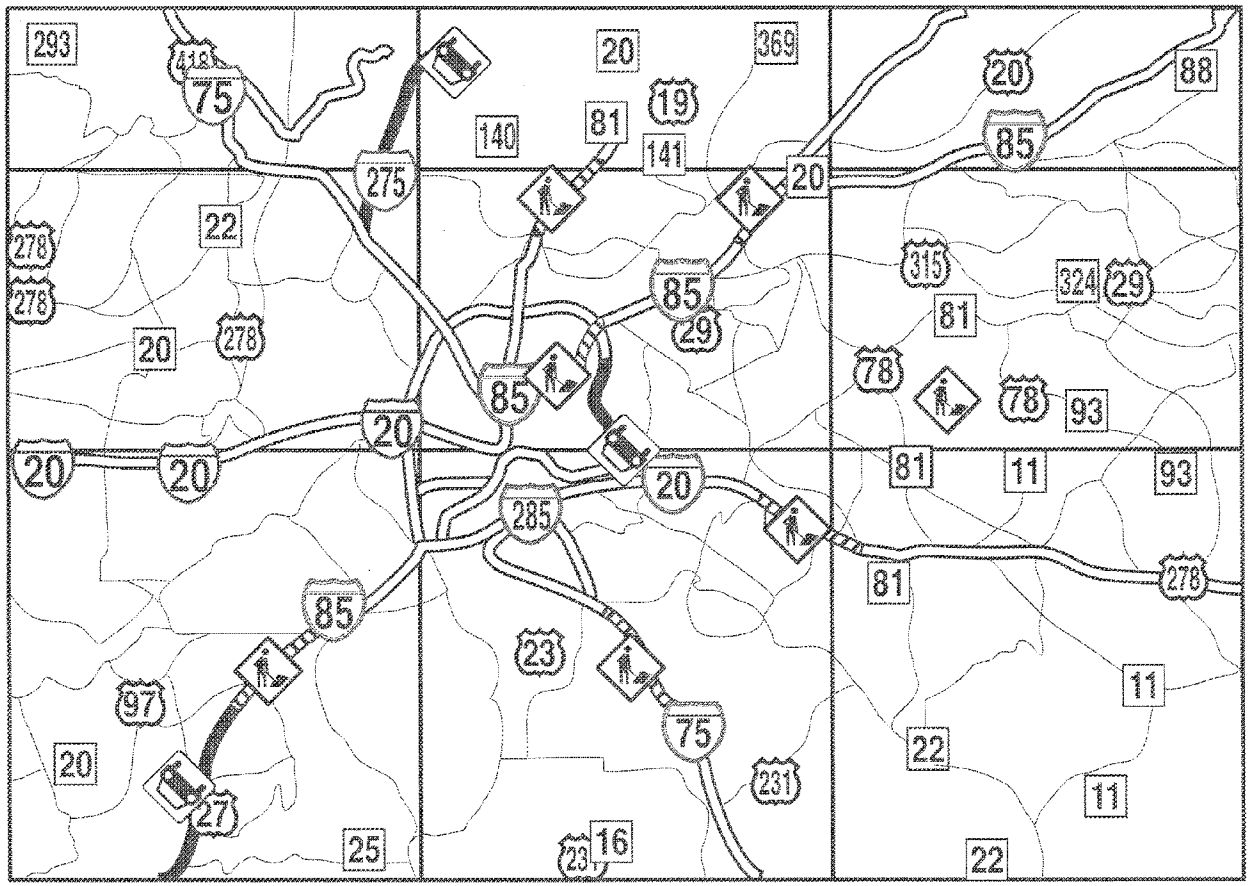
FIG. 1 depicts an exemplary screen shot of a base map zoomed out in an image (showing a first the) where a user sees a one glance snapshot of the entire market according to an exemplary embodiment of the present invention.

As noted above, conventional traffic data services have been targeted at GPS navigation systems. Thus, in conventional systems, a satellite radio subscriber can be supplied with real-time traffic information which can enable a vehicle's navigation system or personal navigation device (PND) to display constantly refreshed and current traffic conditions. Moreover, a premium version of this service also allows dynamic rerouting and other functions within the navigation device. However, such data is not currently provided in the absence of a non-navigation traffic service.

In exemplary embodiments of the present invention, an alternative method for displaying traffic information can be provided, which allows such services to be offered across an entire range of products or vehicles that have reasonably sized graphical screens, and not just those vehicles fitted with a GPS navigation system. In exemplary embodiments of the present invention such a data service can be provided to vehicles having a display capable of displaying a map image and graphical icons, but not having navigation system functionality.

In exemplary embodiments of the present invention, any broadcast media can be used to broadcast traffic data. Such broadcast media can include, for example, satellite radio, digital radio, standard radio, RDS, DAB, etc.

In exemplary embodiments of the present invention, the same traffic data that is used in either the current Sirius Traffic and XM NavTraffic services can be used, with (i) no over-the-air changes or additions to accommodate the new service, and (ii) with no change in bandwidth or data transmission rate to accommodate the new service.

In exemplary embodiments of the present invention, a driver who already knows where he is going (for example on a daily commute) can see the conditions on his road ahead. This can, for example, help him to make decisions on which route to take to a destination. In alternate exemplary embodiments of the present invention the non-navigation based (hereinafter "non-nav") service can sit alongside a telematics based turn-by-turn directions service.

In exemplary embodiments of the present invention, such a non-nav traffic service can be considered as an "infotainment service", i.e. information transmitted over a broadcast data channel to a receiver. Software in the receiving product (called the "HMI") can then interpret this data and present it to the user through a user interface ("UI").

In exemplary embodiments of the present invention, the graphical display of traffic information can be, for example, overlaid on a limited functionality image or picture of a city or regional road network. This allows a driver to look at a small display (such as, for example, a 4-10" display) in their vehicle, or on their portable device, and to view traffic information at their current location. Such a simple geo-referenced road network image can be provided by a carrier such as Sirius XM as a basis for the service, where the traffic information is broadcast across the Sirius and XM networks as digitally encoded traffic data.

In exemplary embodiments of the present invention the data service does not rely on a road geometry database or map to be resident in the receiver, and in such exemplary embodiments nearby traffic conditions can be displayed using a simple display. Thus, in exemplary embodiments of the present invention, data services can be provided that expand the range of target head units from navigation based systems to non-navigation based systems.

In exemplary embodiments of the present invention, the following exemplary hardware and system configuration can be assumed: (i) GPS present or a cellular location determining mechanism using, for example, time distance of arrival or other technique; (ii) no on board map database or routing database; (iii) no dedicated hard keys or soft keys; and (iv) an Alert-C decoder in the head unit to decode non-navigation traffic messages.

In exemplary embodiments of the present invention, a map can be stored as a digital picture, such as, for example, in the JPEG format, depicting a road network in a major metropolitan area. Traffic data can then, for example, be overlaid on this picture. If there are 80 different market areas being covered across North America, then 80 corresponding pictures can be stored, for example, in an exemplary head unit. While the initial set of 80 markets/images can, for example, be stored locally, a method of adding new market images over-the-air as required can also be provided.

In contrast, traditional navigation systems rely on a large, expensive, and complex database of road geometry. Thus, a navigation system supplier has to digitally draw their own map using the road geometry in the database, which often requires significant memory and processing to draw the maps on a screen.

The following Glossary contains some relevant terminology.

| Term | Definition |
|---|---|
| Aftermarket | An Aftermarket Sirius or XM ("SXM") radio is any radio that is not factory installed in a vehicle, and therefore includes a wide range of products including portables, plug & play radios, home radios, and retail-installed automotive head units. (See also the definition for OEM.) |
| Authorized | A channel is authorized for a SXM radio if SXM has provided (through over the air signaling or special factory activation) authorization to that radio to decrypt and play that channel. |
| Data Service | An SXM Data Service is a channel that is used to receive data instead of live audio, for example SXM NavTraffic, SXM WX Weather, stock tickers, sports scores, or channel graphics updates. |
| Data SID | The Service ID (channel) over which an SXM Data Service is received. |
| Entry Navigation | Lower Cost Navigation system, typically around $1000 MSRP |
| Extensible design | The art and science of designing a service and protocol so it can be easily expanded in capability over the future without causing issues for first generation implementations. |
| Free to air | An SXM channel is "free to air" if it does not require activation of the SXM radio to be received and played. Channel 1 (the "Preview Channel") is always free to air. SXM may also make some other channels free to air. |
| HMI | Human-Machine Interface. This software runs in an SXM radio and controls a SXM receiver module, and presents the UI to the listener. |
| HU | Automotive Head Unit |
| Low-Cost Navigation | Reduced cost navigation system through use of a single sensor, simple map, smaller display size, or removable flash based memory. |
| Non-nav navigation | A system in the vehicle to display traffic information in a vehicle, but not provide navigation routing capabilities |
| OEM | In this document, OEM is reserved to mean "automotive OEM." An OEM SXM radio is any radio that is factory installed in a vehicle. (See also the definition for Aftermarket.) |
| OTA | Over The Air |
| PDD | Product Definition Document |
| Premium Navigation | Automotive Navigation System, typically $1800 or more MSRP |
| PND | Portable Navigation Device |
| Protocol | A technical specification of the data format used to transmit the data over the air. |
| SID | Service ID. The # assigned to an SXM channel that is not visible to the user, from 0 to 255. Each channel is assigned a Channel No. and a SID. The SID for a channel rarely changes, whereas SXM may change the corresponding Channel No. for a channel from time to time. |
| UI | User Interface |
| Use Case | An example of the service application, typically involving exemplary customers, useful for deriving service requirements. |

In exemplary embodiments of the present invention, a non-nay traffic service can be provided, which can be, for example, an extension of an SDARS traffic service, such as, for example, the XM NavTraffic and/or Sirius Traffic services. In exemplary embodiments of the present invention, using existing resources, such current traffic services can be made to simulate in a non-navigation environment the services conventionally provided in a navigation environment (to a certain extent).

Non-Navigation Traffic Information Data Service Overview

Over the next few years, it is anticipated that large (e.g., minimum 4 inch diagonal), high resolution displays will become much more prevalent on new vehicles. OEMs will want to maximize the use of these displays with minimum additional hardware cost. In exemplary embodiments of the present invention, these displays can be used to show additional Sirius SXM data services, including, for example, traffic information.

In exemplary embodiments of the present invention a non-nav traffic service can allow the current traffic information services offered by, for example, Sirius SXM (Sirius Traffic and SXM NavTraffic) to be used with lower cost hardware than traditional navigation systems. This can, for example, allow traffic information to be offered across an entire vehicle model line, and not just on the premium models with full functionality navigation systems.

In exemplary embodiments of the present invention, graphic display of traffic information can be provided on a limited functionality image of a road network. In exemplary embodiments of the present invention such a simple map image can be provided by an SDARS provider. Relative to the conventional navigation system, the costs of such an exemplary overall system are reduced due to the lower hardware, graphics, memory and map requirements.

Hardware Assumptions

In exemplary embodiments of the present invention, exemplary systems can include GPS position information, or alternatively, cellular location finding techniques can be used to determine the user's current position. In exemplary embodiments of the present invention, no embedded map database is required, rather only static map images, which can, for example, be provided to OEMs by an SDARS provider. In exemplary embodiments of the present invention no routing database or routing engine is required. In exemplary embodiments of the present invention an Alert-C decoder can be provided in a head unit to decode, for example, an SDARS traffic information data stream. Additionally, for example, custom Traffic Message Channel (TMC) location tables can be provided, where a receiver is able to handle them.

Feature Overview

The following is a summary of exemplary features in an exemplary non-nav traffic data service according to exemplary embodiments of the present invention.

| Feature | Non-Nav (no GPS) | Non-Nav + GPS | Full Functionality GPS Nav | Comments |
|---|---|---|---|---|
| Display of incident traffic information for current 80 markets on a map | Yes | Yes | Yes | Identical info is available all three systems |
| Display of flow traffic information for current 78 markets on a map | Limited mile coverage in some markets | Limited mile coverage in some markets | All broadcast info | In certain markets, non-nay flow mile coverage may be a subset of nav to reduce clutter and improve user experience |
| Traffic data resolution is TMC segment | Yes | Yes | Yes | |
| Flow traffic message resolution is granular | Yes | Yes | Yes | Same flow speed bucket granularity on all three systems |
| Map shows all roadways with appropriate labels in each market | All key roadways | All key roadways | All | Non-Nav map in each market will show all roadways that have flow coverage plus all key roadways for location reference purposes |
| Map will support various zoom levels per market | Yes | Yes | Yes | Non-nav will have predefined zoom levels |
| Show relative location of vehicle on the map | No | Yes | Yes | |
| User will he able to select a traffic incident on the map and see additional information | Yes | Yes | Yes | |
| Traffic flow information displayed as colored dots or lines alongside major highways | Yes | Yes | Yes | A method for following highway contours is proposed |
| Display of incident traffic information on a list for your current market | Yes | Yes | Yes | |
| User can manually select their market or zoom level | Yes | Yes | Yes | A list of markets will be provided for Non-Nav |
| Device can automatically select their market or zoom level based on GPS position information | No (manual) | Yes (transition from one image to the other can be automatic) | Yes (map is always tracking the GPS location) | |
| Show traffic information on the road and direction that you are currently driving | No | Yes | Yes | |
| Show traffic information, sorted by proximity to your actual location | No | Yes | Yes | Non-Nay application software will do this |
| Navigation routing | No | No | Yes | |
| Dynamic rerouting around traffic | No | No | Yes | |

-continued

| Feature | Non-Nav (no GPS) | Non-Nav + GPS | Full Functionality GPS Nav | Comments |
|---|---|---|---|---|
| Allow user to manually select favorite routes | Future extension | Future extension | Yes | |
| Allow device to learn commonly driven routes, and provide traffic information on these favorite routes only | Future extension | Future extension | Application dependent | |
| Accommodates expansion of total number markets or total miles of coverage | Future extension | Future extension | Device or hardware dependent | |
| Accommodates expansion of TMC location tables | Future extension | Future extension | Yes | |

Map Image Information

In exemplary embodiments of the present invention, in order to show traffic information on a map, a simple geo-referenced 2D image of a map can be utilized. Thus, a series of map images can be preloaded in a receiver and provided in a standard format by an SDARS provider, for example. Additionally, the specification for these files can also be provided to an OEM on request, if, for example, they wish to create their own images to differentiate their products.

In exemplary embodiments of the present invention such images can, for example: (i) support any display several inches or larger; and (ii) support various commonly used aspect ratios. In exemplary embodiments of the present invention most markets will be covered by one image per market, and larger markets may need multiple images to support additional zoom levels. Market images can, for example, show road network and names of the highways, and can scale so that TMC location information can be overlaid accurately. In exemplary embodiments of the present invention labels can be located such that any traffic information can be overlaid, with the labels still visible. In exemplary embodiments of the present invention such images can support the 80 current traffic markets in the US and Canada, including inter-city traffic coverage.

In exemplary embodiments of the present invention multiple markets can be displayed on one screen, such as when, for example a user is located between closely located traffic markets, such as Baltimore and Washington D.C., for example. In exemplary embodiments of the present invention the images can, for example, support day/night coloring, or an image can be selected that suits both purposes.

Figure 2:
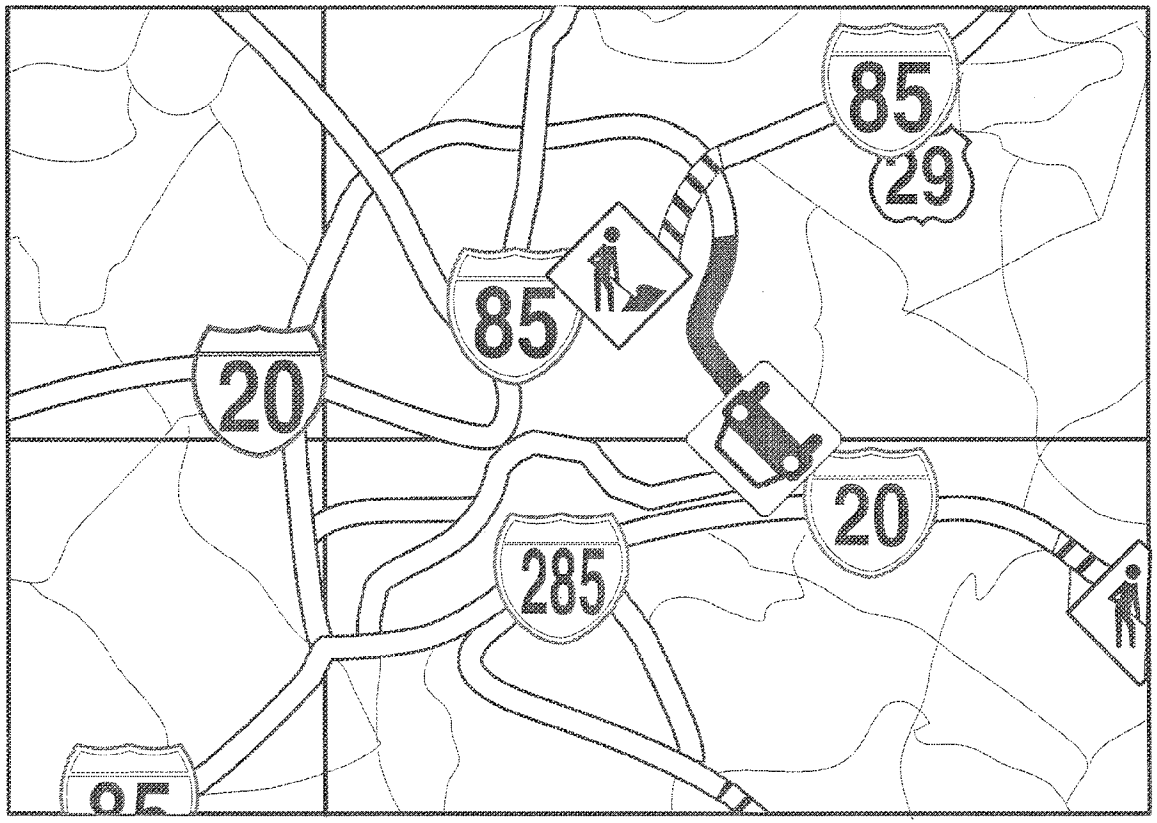
FIG. 2 is screen shot zoomed out illustrating an image of city center where a user sees a higher resolution traffic image of the city center (in a second tile) according to an exemplary embodiment of the present invention.
Figure 3:
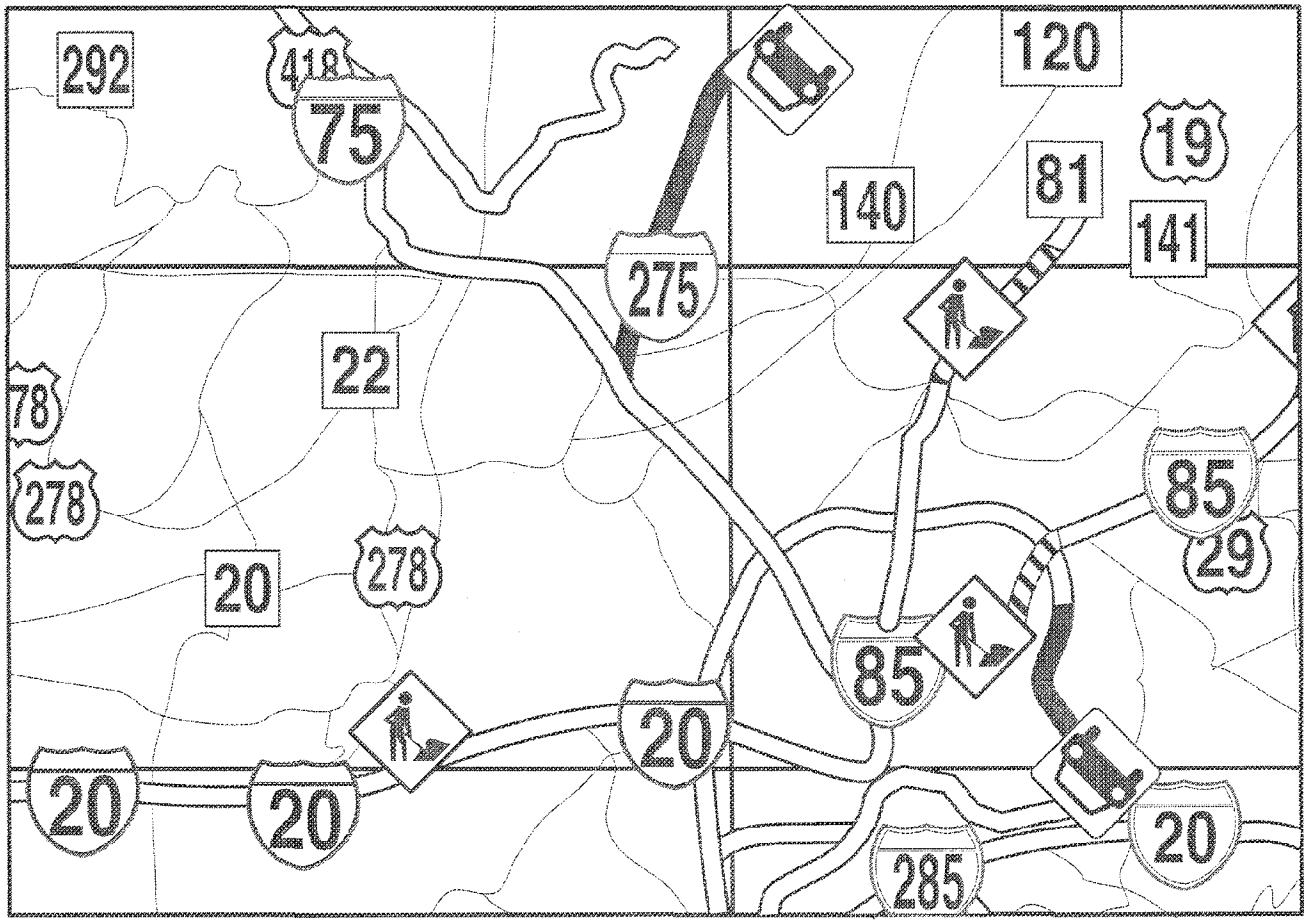
FIG. 3 is a screen shot (of a third tile) where a user sees a higher resolution traffic image when traveling to/from north/west/northwest of the city according to an exemplary embodiment of the present invention.
Figure 4:
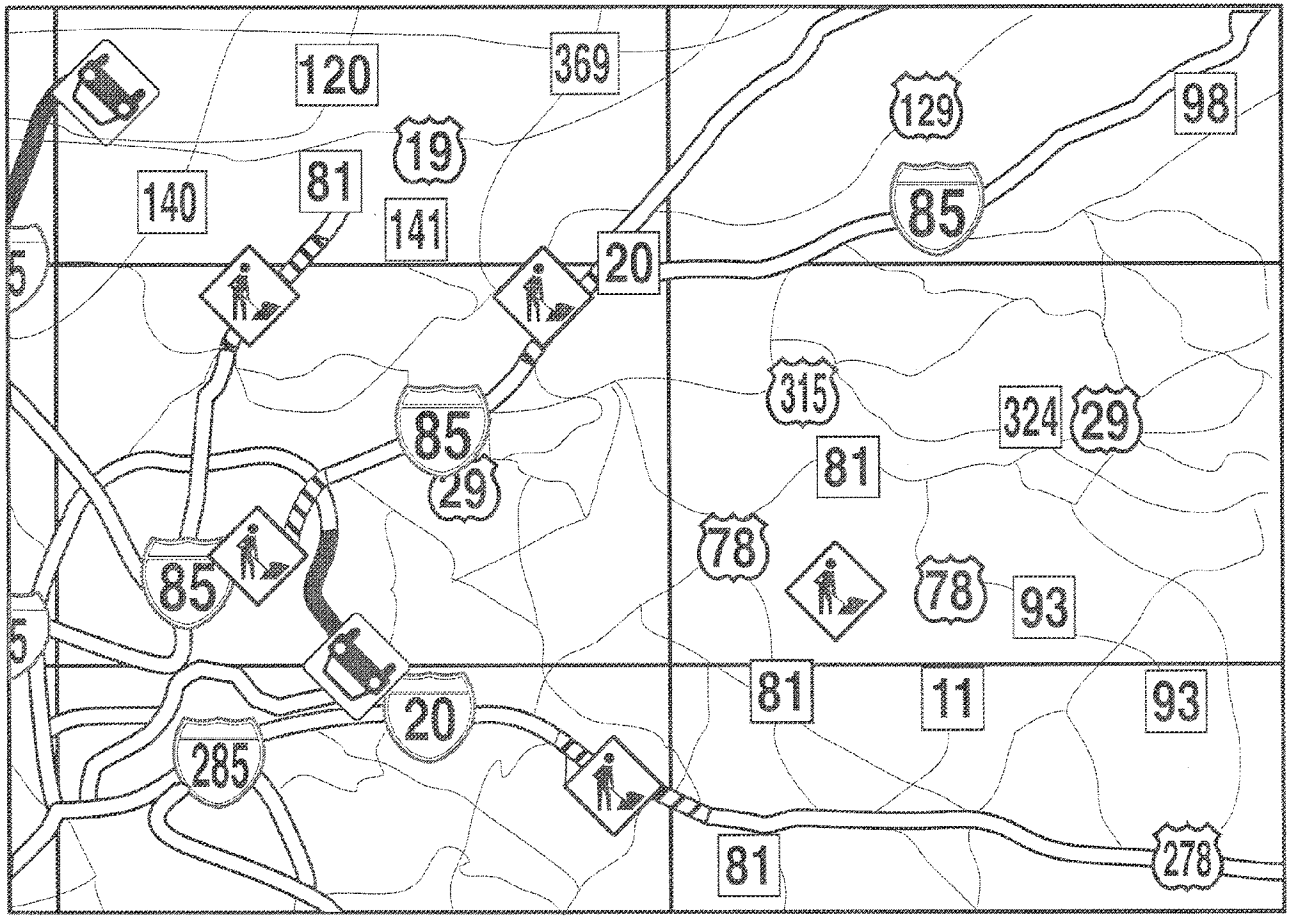
FIG. 4 is a screen shot (of a fourth tile) where a user gets a higher resolution traffic image when traveling to/from east/north/northeast of the city using a non-navigation system according to an exemplary embodiment of the present invention.
Figure 5:
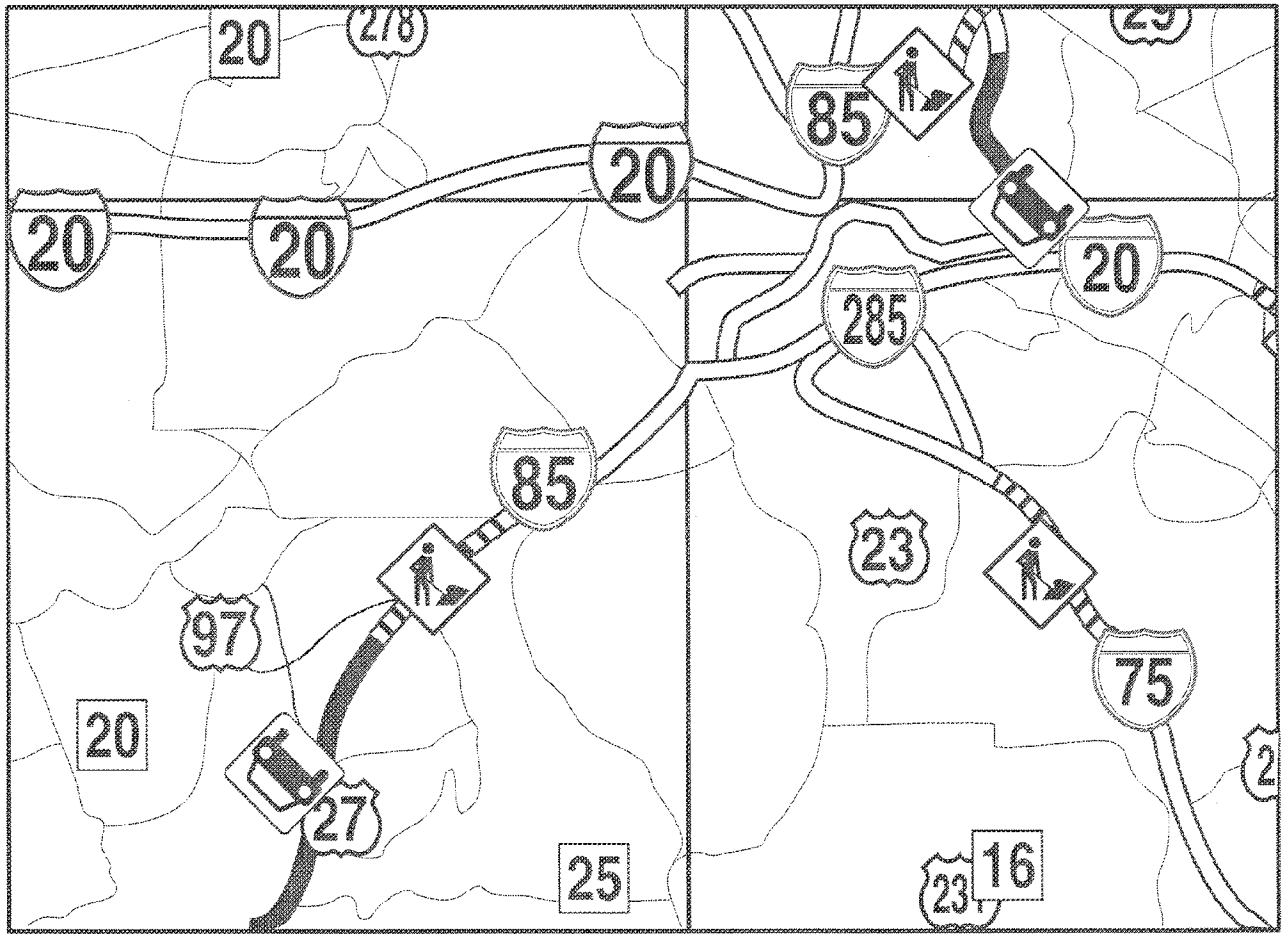
FIG. 5 is a screen shot (of a fifth the) where a user gets a higher resolution traffic image when traveling to/from south/west/southwest of the city using a non-navigation system according to an exemplary embodiment of the present invention.

In exemplary embodiments of the present invention, a base image in a large market may need to be tiled (i.e., provide multiple zoomed-in pictures). An example of such tiled imaging is shown in FIGS. 1-6. With reference thereto, it is assumed that the colored highways have traffic coverage. In this example, six tiles are shown—one zoomed around the city center, and the other four for users that are traveling from/to the city center to/from the four outer corners of the city. In exemplary embodiments of the present invention, FIG. 1 can always be available as a manual option. FIG. 1 depicts a base zoomed out image of the entire relevant area of this example, and FIG. 2 depicts a zoomed-in view of the city center, giving the user a high resolution traffic image thereof.

In exemplary embodiments of the present invention all zoomed-in tiles can be created with the same resolution. In exemplary embodiments of the present invention tiles can, for example, have an overlap between them so that a user always has forward information before switching to the next tile. Thus, as a user drives from southeast to northwest, for example, a user should be able to see the display switching from that of FIG. 6 to that of FIG. 2 and finally to that of FIG. 3. Or, alternatively, for example, moving from southwest to northeast, a user should be able to see the display switching from that of FIG. 5 to that of FIG. 2 and finally to that of FIG. 4. In exemplary embodiments of the present invention this switching can be performed automatically if GPS or other location finding service is available. Alternatively, multiple tiles can be simultaneously displayed, if they can be interlaced effectively.

Non-Nav Traffic Images

These form the basis for the Non-Nav traffic service. In exemplary embodiments of the present invention simple geo-referenced 2D map images can be provided and preloaded in an exemplary device. Non-Nay traffic images can have the following exemplary features n exemplary embodiments of the present invention:

- Images can support displays between 4 and 10 inches. Images can be targeted at displays with resolutions between 320×240 and 800×480. Higher resolution displays can be supported with the creation of additional custom images on request from an OEM;
- Images can support various commonly used aspect ratios;
- Most markets will have 3 or 4 images to support multiple zoom levels and display sizes;
- Market images can show the road network and names of the highways;
- Labels can be located such that any overlaid traffic information will not obscure them;
- All 112 current CBSA traffic markets in the US and Canada can be supported, including intercity traffic coverage, if available for markets adjacent to each other, and additional images can be created to support future markets as necessary;

All four images per market can show the same geographic footprint, and each image can offers a higher resolution than the previous one so as to support various zoom levels. Images can be created, for example, such that Image 2 is twice the resolution as Image 1, Image 3 is twice the resolution as Image 2, etc.

In exemplary embodiments of the present invention, the following exemplary resolutions can be used:

| | |
|---|---|
| Image 1 | 400 × 240 pixels (only required for low resolution displays) |
| Image 2 | 800 × 480 pixels |
| Image 3 | 1600 × 960 pixels |
| Image 4 | 3200 × 1920 pixels |

There is no overlap of images, and images are always abutted together. Where there are adjacent markets, such as, for example, Baltimore and Washington, D.C. the images can be abutted together and shown simultaneously on a display.

Figure 6A:
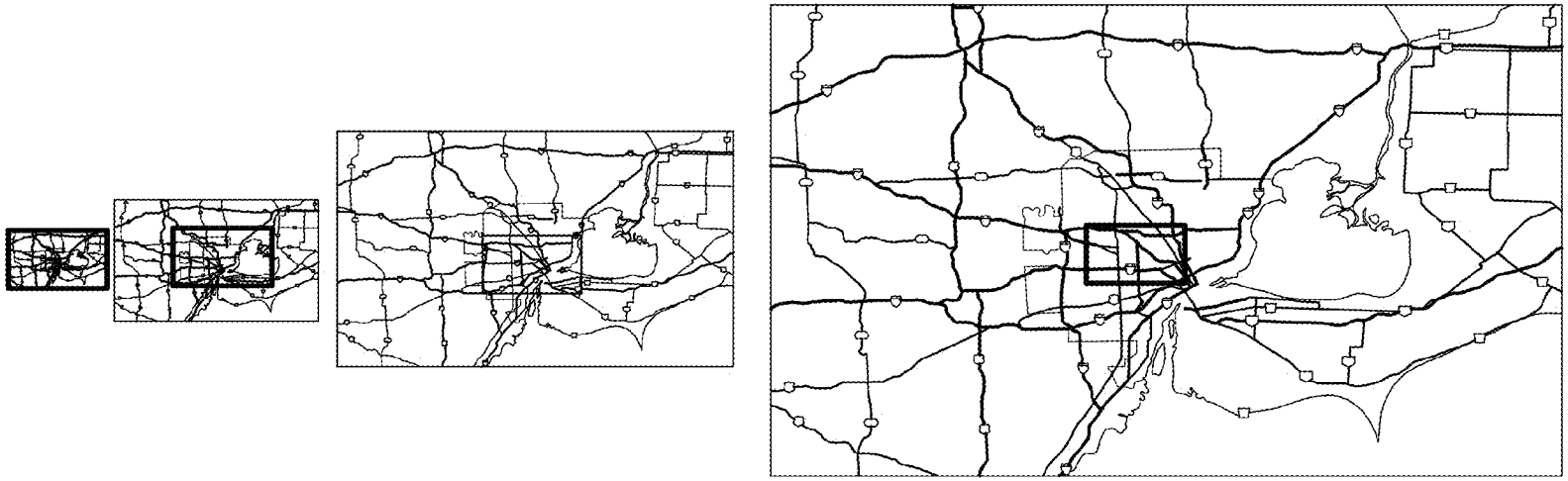
FIGS. 6A through 6E are exemplary screen shots of an exemplary data service according to an exemplary embodiment of the present invention.

FIG. 6A depicts four exemplary non-nav traffic images provided for the Detroit market. FIGS. 6B through 6E illustrate exemplary versions of Images 1-4, as described immediately above, for the same Detroit market, as next described.

Figure 6B:
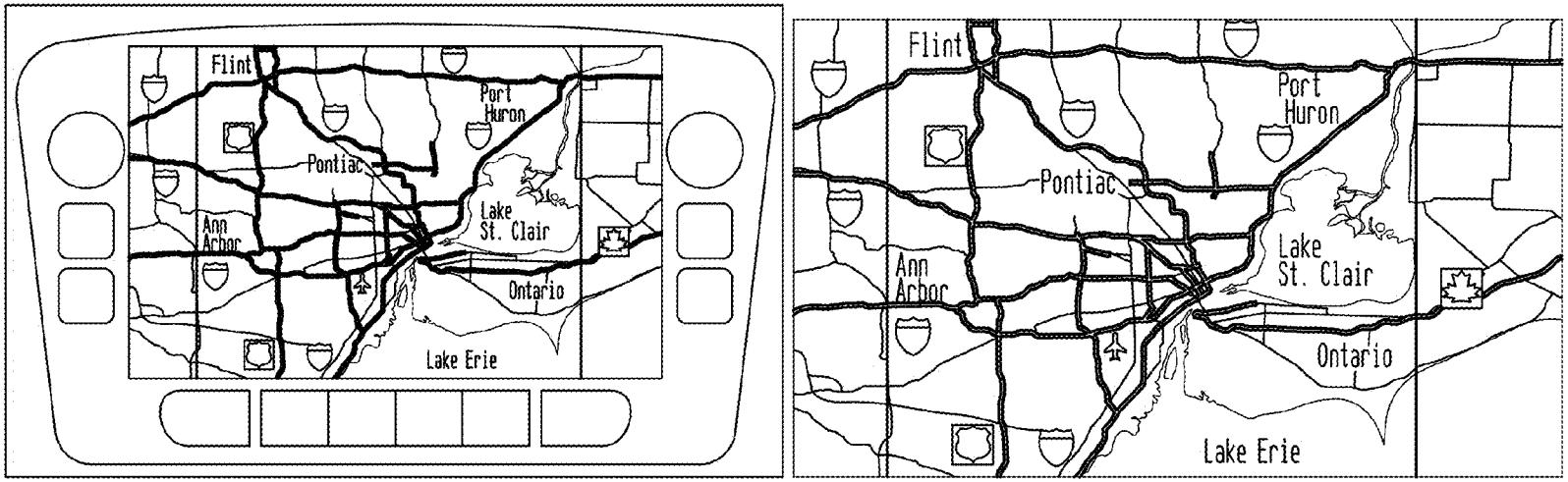

FIG. 6B depicts an exemplary "Image 1", shown full screen on a 240×400 display. For a 240×320 display, the 40 pixels on the left and right of the image would not be displayed. A user could pan left and right to see these 40 pixels if necessary. The text on this image is sized for display full screen on a small low resolution display.

Figure 6C:
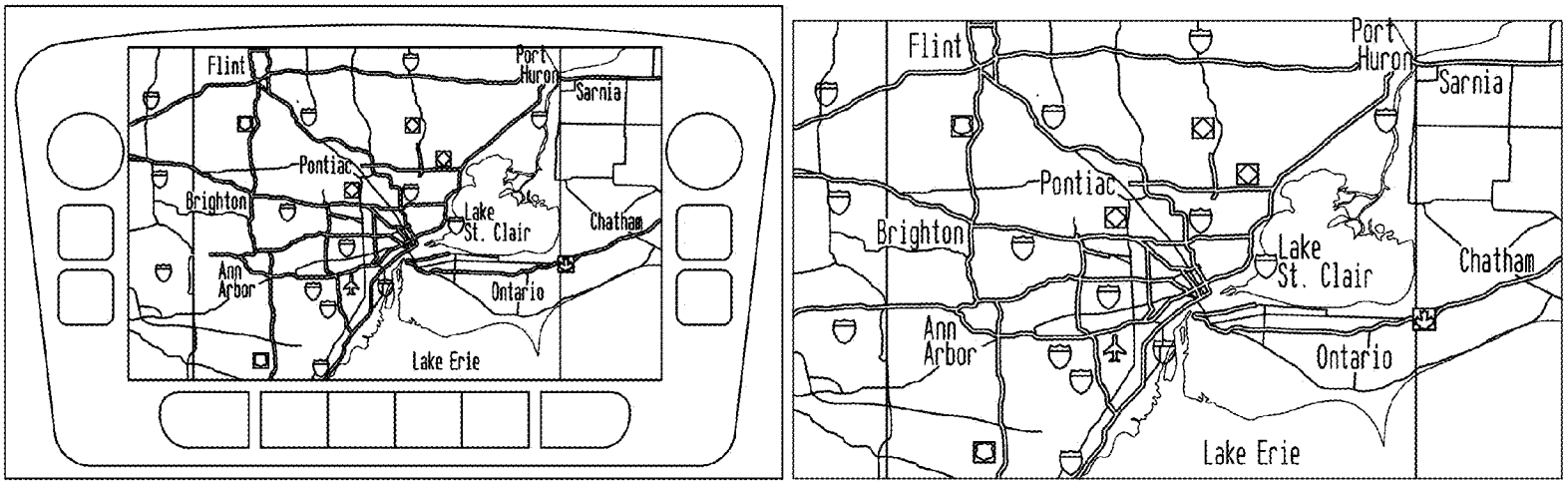

FIG. 6C depicts an exemplary "Image 2" shown full screen on a 480×800 display. For a 480×640 display, the 80 pixels on the left and right of the image would not be displayed. A user could pan left and right to see these 80 pixels if necessary. This image would also be the first zoom level for a small display (240×320 or similar)

Figure 6D:
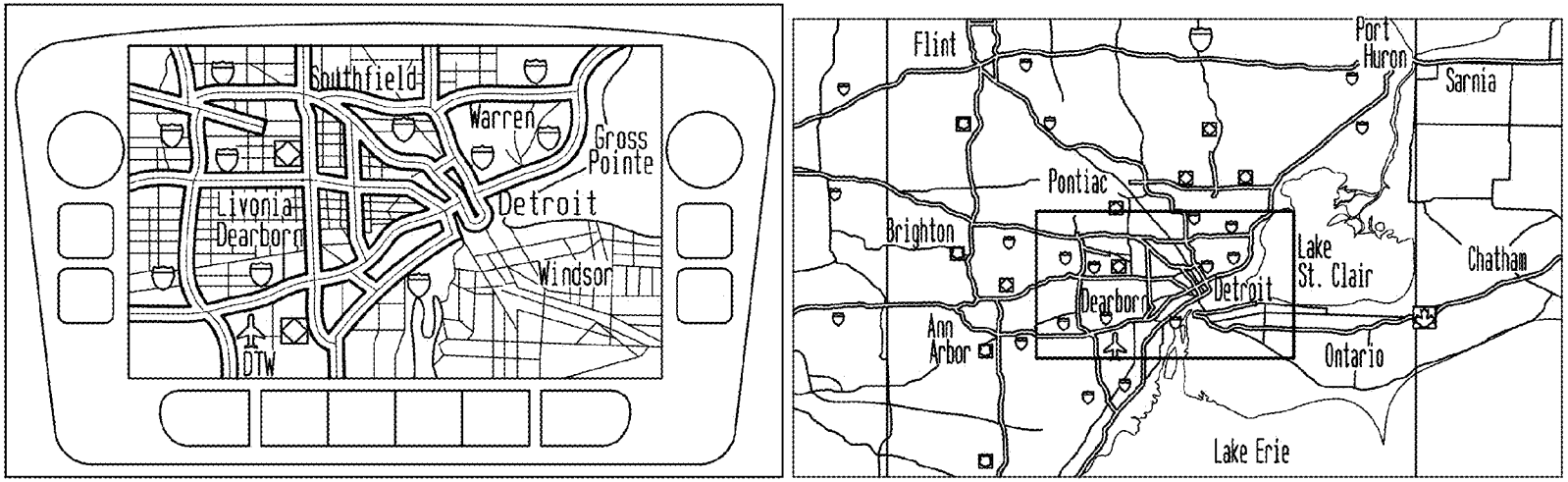

FIG. 6D depicts an exemplary "Image 3" shown centered on a 480×640 or 480×800 display. A user can, for example, pan around the entire image manually to see other parts of the traffic market, or, for example, the image can automatically be centered on the vehicle's GPS location. The text on this image is not sized for displaying this entire image on a display at once. The text is sized for windowing into this image as the above examples show. This image is the second zoom level on a small display (240×320 or similar) and the first zoom level on a larger display (480×640 or similar)

Figure 6E:
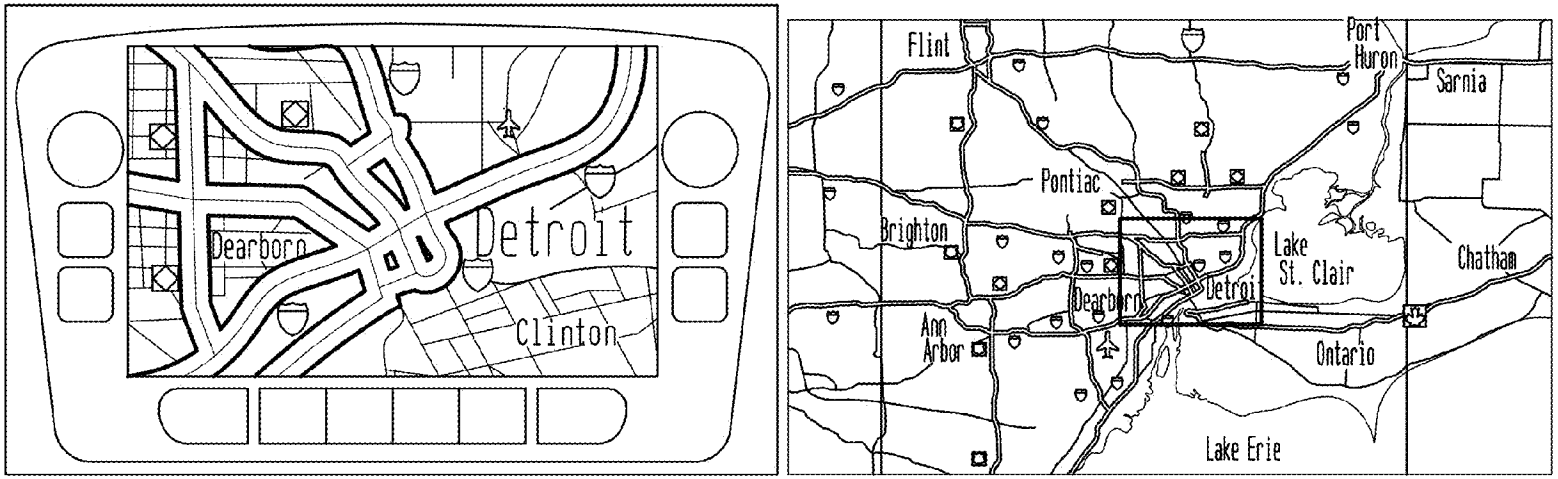

FIG. 6E depicts an exemplary "Image 4" shown centered on a 480×640 or 480×800 display. A user can pan around the entire image manually to see other parts of the traffic market, or image can automatically be centered on the vehicle's GPS location. The text on this image is not sized for displaying this entire image on a display at once. The text is sized for windowing into this image as the above example shows. This image is the third zoom level on a small display (240×320 or similar) and the second zoom level on a larger display (480×640 or similar)

Day/Night Views

Figure 7:
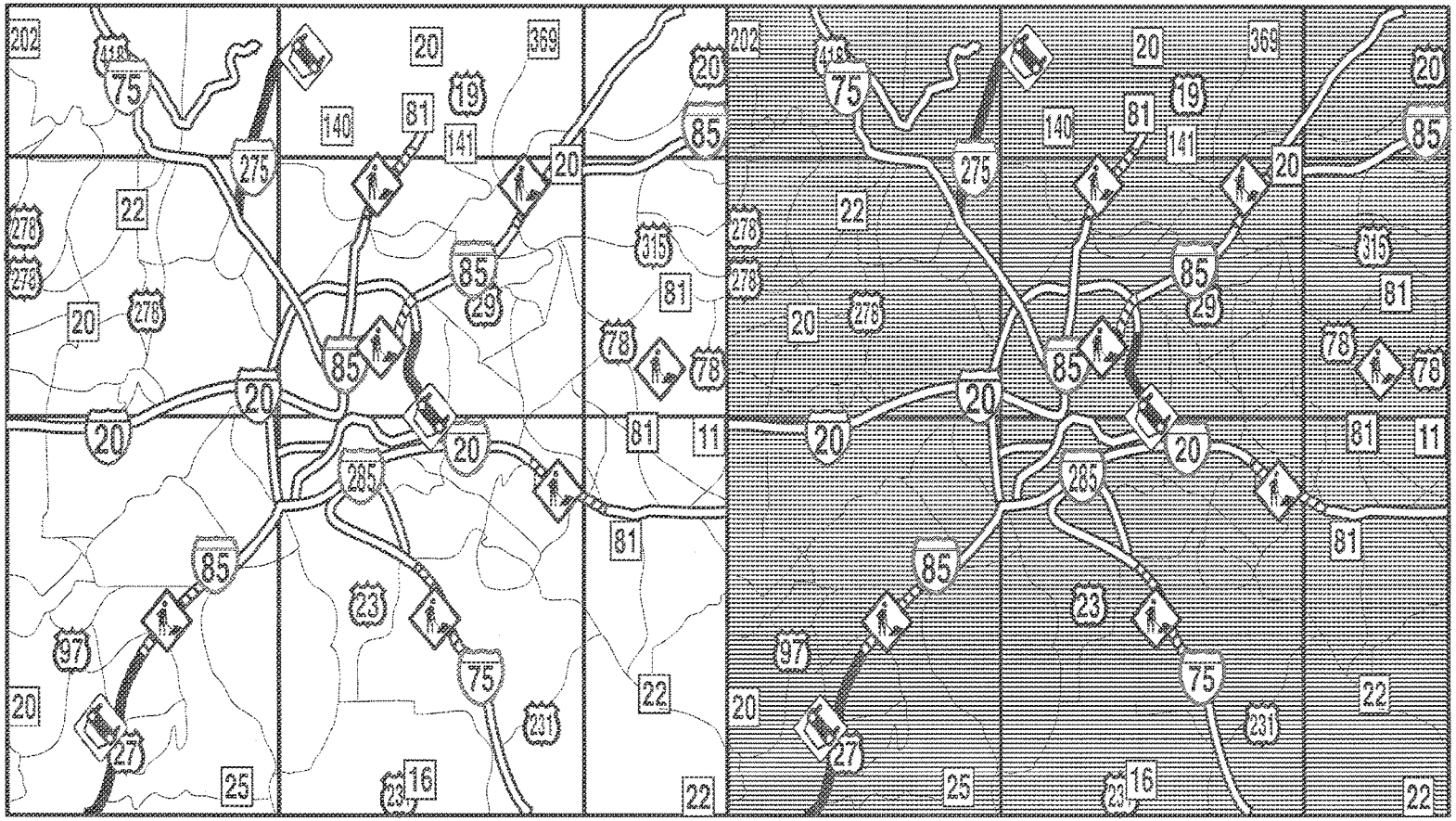
FIG. 7 is a screen shot of possible day and night view that can be used in exemplary embodiments of the present invention.

FIG. 7 depicts side by side examples of possible day (right side) and night (left side) views. In exemplary embodiments of the present invention separate Day/Night views of each tile can be provided, or alternatively a method to change the color of the tile.

Ability to Support Split Screen View

Figure 8:
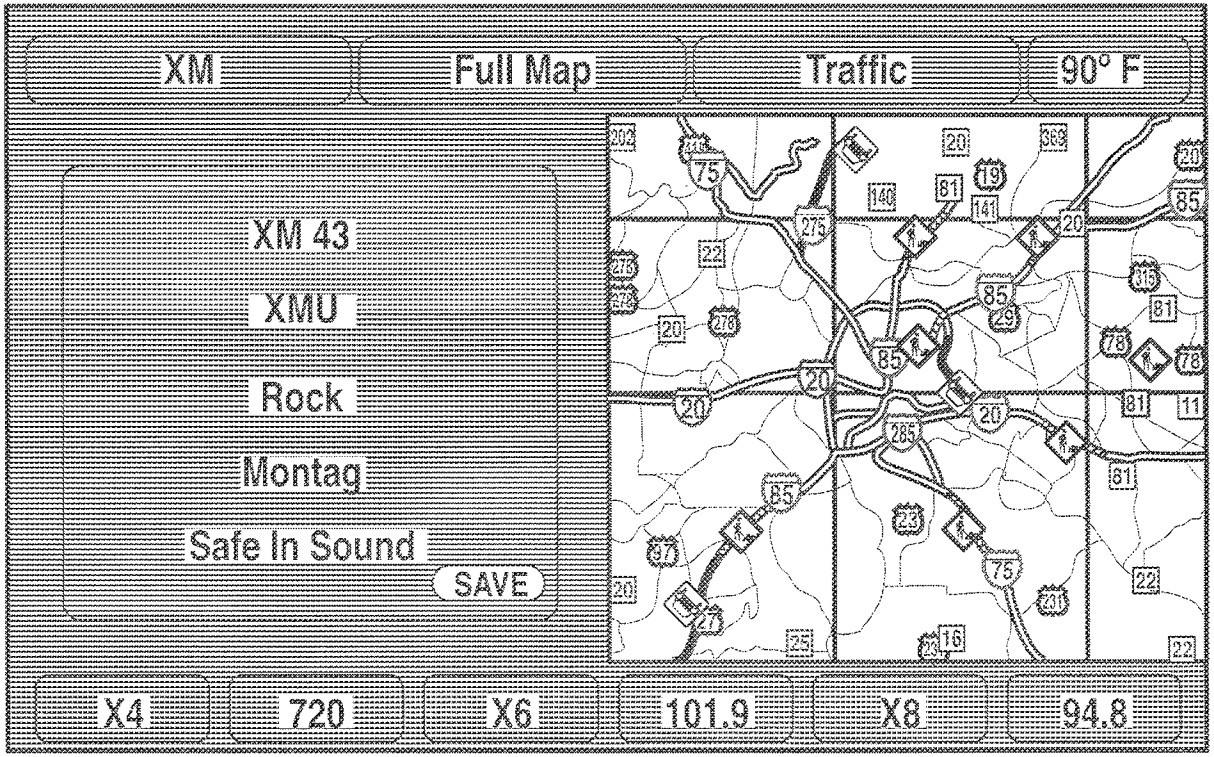
FIG. 8 is an illustration of a split screen view where traffic data is overlaid over a map on one portion and music data is provided on a second portion according to an exemplary embodiment of the present invention.

In exemplary embodiments of the present invention maps can support a split screen, where audio service and traffic data may be displayed simultaneously on a screen, as depicted in FIG. 8. In exemplary embodiments of the present invention, if an OEM chooses to use this split screen format, the traffic map can still be required to be displayed so that it is still at least shown in a 4 inches diagonal area, so as to provide sufficient readability and resolution.

Traffic TMC Location Tables

In exemplary embodiments of the present invention, traffic data can be referenced to TMC Location Codes, which have lat-long (i.e., latitude-longitude) co-ordinates. In exemplary embodiments of the present invention TMC Consortium location tables can be used to geo-reference traffic data to a map, and traffic information in the traffic data services can contain location information referenced to these Consortium TMC location codes, thus allowing the traffic data services to be used with a map.

Thus, in order for end-users to make use of the traffic information, each device must include a TMC location code lookup table to convert the TMC location code back into a Lat-Long. In exemplary embodiments of the present invention an SDARS provider can supply the necessary information for TMC location tables. For example, Sirius XM can provide a customized version of a TMC database, with unused TMC locations (locations where map can become too cluttered or locations such as Alaska and Hawaii) removed to reduce memory footprint.

In exemplary embodiments of the present invention a custom location code database can be created and provided to use with the map images. This can ensure, for example, that standard "TMC-AlertC, Traffic information" can be used. In exemplary embodiments of the present invention, traffic information can be overlaid on each image using such a custom location code database, ensuring that the traffic data follows the road geometry on the image, without the need for an underlying road geometry/map database. Such images can be geo-referenced, for example, with latitude/longitude information. This, in conjunction with the custom location code database allows it to be used to overlay the traffic information. In exemplary embodiments of the present invention maps can have individual TMC traffic location tables that can identify the road segments visible in each map image.

As noted above in connection with FIG. 6, in exemplary embodiments of the present invention the map images used can be, for example, either abutting tiles, or one large tile covering each city. Multiple images can be supplied for each city, for example, each covering the same geographic area, but each showing the area at a different resolution. This allows a user to zoom in and out on the image, but still be able to read the text on the screen, as all text is sized for the image resolution.

Displaying Flow Speed Data on the Map as Dots or Lines

In exemplary embodiments of the present invention, in order to display flow data as, for example, colored lines alongside a freeway or road, the flow data can be drawn onto the map by joining the dots between TMC Location codes. If a map database is not included with the device, flow data will not match the geometry of the road exactly. Thus, in order to ensure that the dots or lines reasonably follow the roadway geometry, in exemplary embodiments of the present invention methods for following highway contours can be used for certain locations. In exemplary embodiments of the present invention the base image of the road geometry can also be created, for example, using the lot/long co-ordinates of the TMC locations, which can ensure that flow data follows the roads.

In exemplary embodiments of the present invention speed/flow information can be drawn on a map as, for example, red/yellow/green lines depicting speed of traffic on the roadways. Alternatively, an exemplary OEM can change these colors to suit their OEM's needs.

In exemplary embodiments of the present invention an OEM can include settings within their UI design, so as to allow a user to select when each color is displayed. For example, a green flow line may be used if speed is an absolute value (55 mph+), or, for example, to show a percentage of the posted speed limit (traffic is moving at 30 mph in a 30 mph speed zone).

In certain large markets, flow miles of coverage on a non-nay implementation can be, for example, a subset of the data actually transmitted by an SDARS provider. This may be necessary to prevent clutter on the image. For example, FC1 coverage would be identical for nav and non-nav services, but non-nav FC2 coverage can be a subset of nav coverage. In exemplary embodiments of the present invention a filter table can be provided to automate this.

Figure 10:
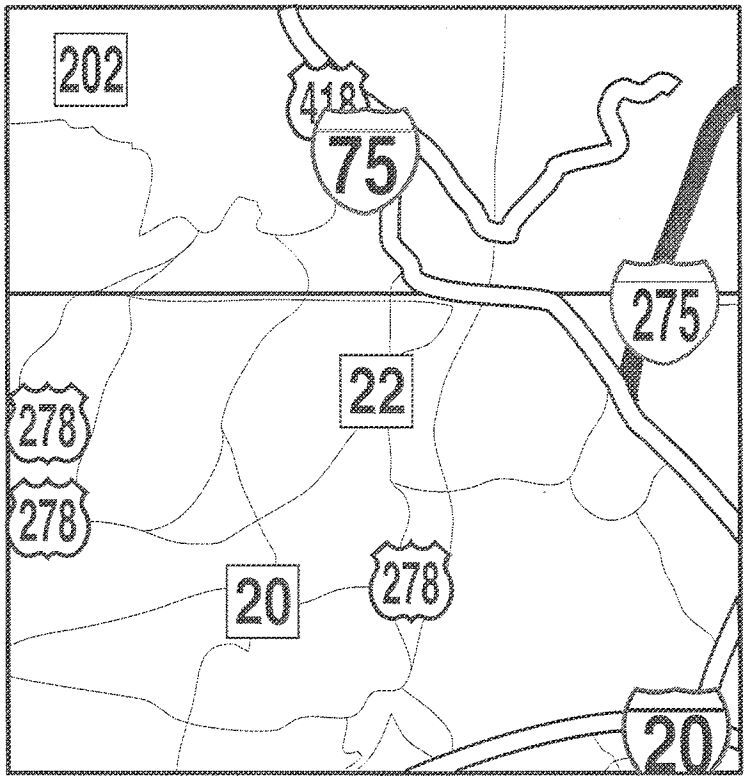
FIG. 10 is an illustration of a map showing flow dots according to an exemplary embodiment of the present invention.
Figure 9:
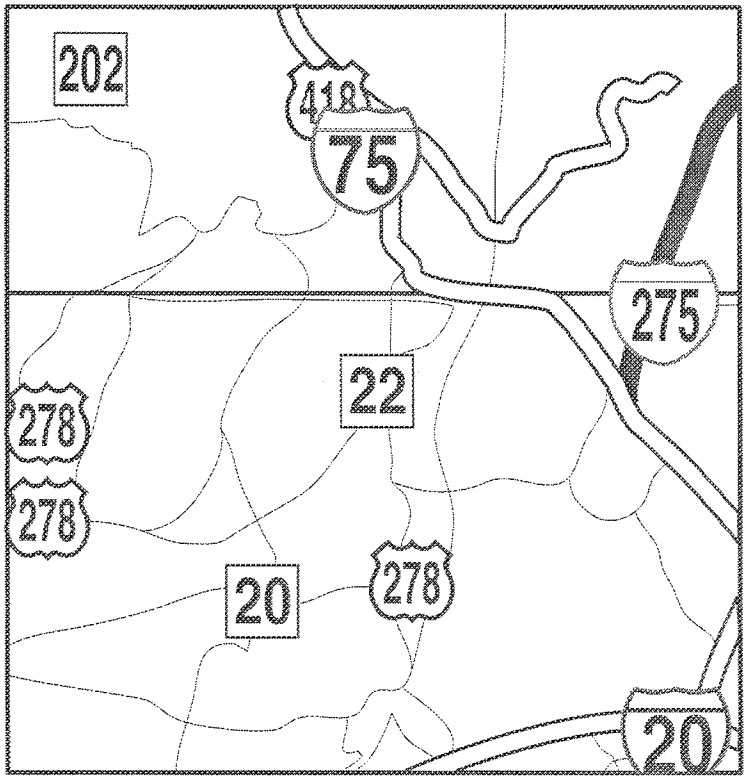
FIG. 9 is an illustration of a map showing flow lines according to an exemplary embodiment of the present invention.

In exemplary embodiments of the present invention, traffic data can be shown, for example, using dots or lines to show traffic data. FIG. 9 depicts an example of using flow lines to show traffic data, and FIG. 10 depicts an example of using flow dots.

Figure 11B:
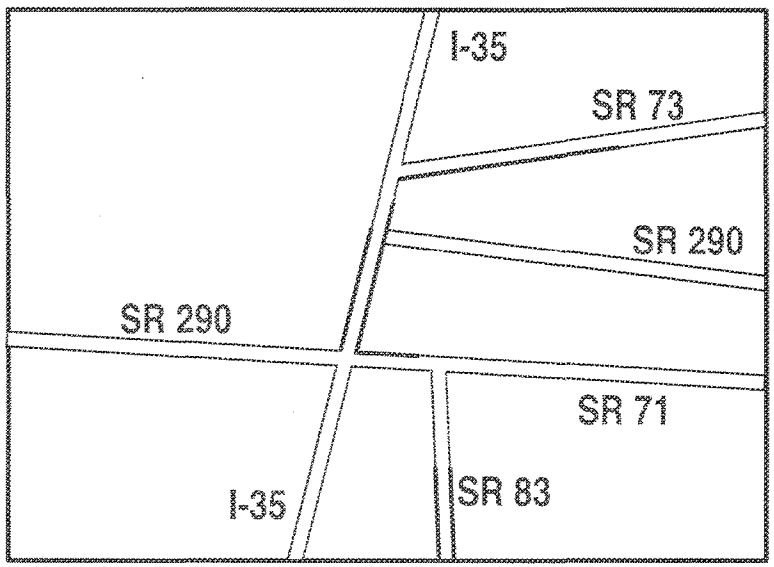
FIG. 11B is the stylized map of FIG. 11A further including the use of color coding to represent traffic flow or speed data in a simplified format.
Figure 11A:
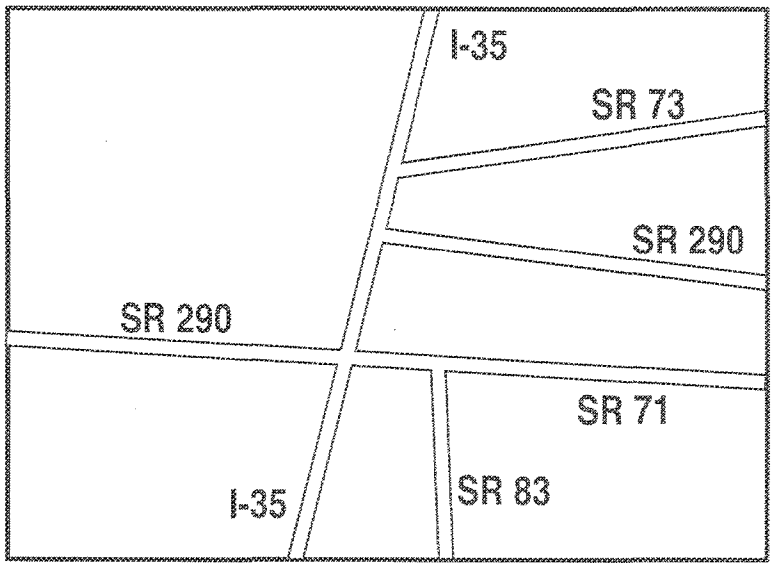
FIG. 11A is an exemplary stylized map using straight lines to represent roads in a particular market according to an exemplary embodiment of the present invention.

In exemplary embodiments of the present invention another option can be to create stylized maps using straight lines of each market. This can, for example, allow for better representation of each market's traffic flow data, although it may make it difficult to overlay latitude/longitude TMC code information. FIGS. 11A and 11B respectively depict exemplary default and heavy traffic condition stylized-type maps for Austin, Tex.

In such exemplary stylized maps, traffic market images can be depicted using simplified road segments, the absence of speed/flow data results in free flow conditions by default, speed/flow data for road segments can be overlaid onto a traffic market image, and each road segment can utilizes existing TMC codes for location and extent.

Displaying Traffic Incident Data on the Map

In exemplary embodiments of the present invention, incident data can be referenced directly to a lat-lon co-ordinate and referenced to the map. Then, touching an incident on the map, for example, can cause any additional information associated with the incident to be displayed.

In exemplary embodiments of the present invention incident messages can be identified by their class so that incident data can be displayed as a list, sorted by incident type/class of message (GPS not required) or proximity to current location (GPS or location finding required). For example, in exemplary embodiments of the present invention a user can see only the accident class message and hide all construction class messages.

Traffic Accident/Incident Icon Types

In exemplary embodiments of the present invention an exemplary system can support standard ISO or SAE icon sets, or custom icons. Thus, OEMs can differentiate their products from each other by offering differing icon sets.

De-Cluttering of Traffic Accident/Incident Icons and Flow Data

In exemplary embodiments of the present invention, it is important that the traffic incident and flow data be de-cluttered at different zoom level tiles. Some of this can be achievable, for example, within the settings in an end user's device. Examples of de-cluttering are switching off construction warning information at certain zoom levels. It may also be necessary to show flow data on FC1 & FC2 roads only when a map is zoomed out, with FC3 and FC4 flow data only displayed at levels of higher zooming in. In exemplary embodiments of the present invention a filter table can be provided to allow de-cluttering decisions to be made.

Figure 12:
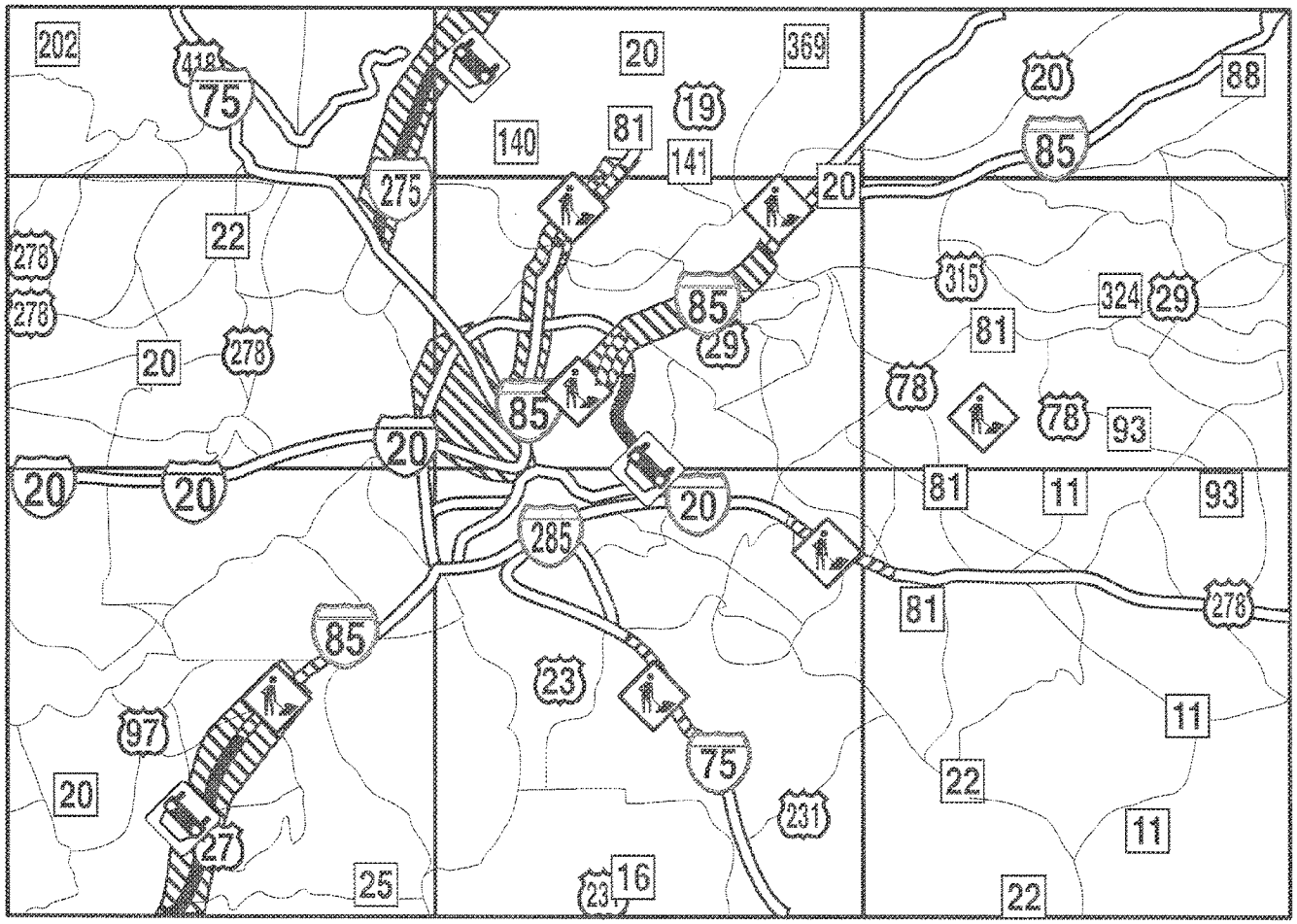
FIG. 12 is a map illustrating where congestion of incident icons hide colored flow data, and wherein such incident data is filtered in a de-cluttering decision according to an exemplary embodiment of the present invention.

FIG. 12 depicts an example showing congestion "incidents", which hide the colored flow data.

Additional Features

In exemplary embodiments of the present invention an exemplary non-nay traffic data service can be both flexible and backwards compatible. In exemplary embodiments of the present invention an exemplary service can allow for (i) expansion of traffic flow miles coverage in existing markets; (ii) addition of new traffic data markets; (iii) addition of intercity traffic coverage; and (iv) road network or road geometry changes.

In exemplary embodiments of the present invention map tiles and associated tables/databases can be updated in an over the air broadcast if new traffic markets are added.

In exemplary embodiments of the present invention a UI can be provided that allows an exemplary device to be put into a "learning" mode, so as to learn the driver's normal routes. Incident messages may only be presented for routes that are on the drivers favorites list.

In exemplary embodiments of the present invention, although not necessary, additional traffic data could be gathered from each vehicle to improve the overall quality of the traffic data service using a back channel.

Non-Nav Traffic Service with No-Display or Limited Capability Display

In exemplary embodiments of the present invention a non-nav traffic data service can be used with no display, using a voice recognition capability as the primary user interlace. This allows the service to be added to a much more diverse range of vehicles or devices, and recognizes that many newer vehicles include some form of voice recognition command and response structure, such as, for example, for using cellular telephones.

In exemplary embodiments of the present invention an exemplary system can store all data service information—including traffic information, weather information, stock price information, gas price information, sports score information into local memory. When a user asks a question about these services using the voice recognition capability, the local memory can be accessed, for example, to provide an immediate answer. TMC location code tables can also be stored locally in the device to provide a lookup table between the over-the-air broadcast format, and a human-interpretable format. In exemplary embodiments of the present invention over the air updates to phonemes can be made.

In exemplary embodiments of the present invention a non-nay traffic data service offers many advantages, such as, for example: (i) entry level service on low-tier vehicles, including motorcycles; (ii) functionality to reduce driver distraction in a vehicle; and (ii allows High-Tier vehicles to differentiate themselves from their competition.

By way of illustration, an exemplary use case for this system can have the following hardware: (i) vehicle has GPS, though it is not necessary; (ii) no onboard maps or routing database; (iii) no dedicated hard keys or soft keys; (iv) consortium traffic location tables are stored in an end-user's device; and (v) Tier-1 has included an Alert-C decoder in the end user's device.

Figure 13:
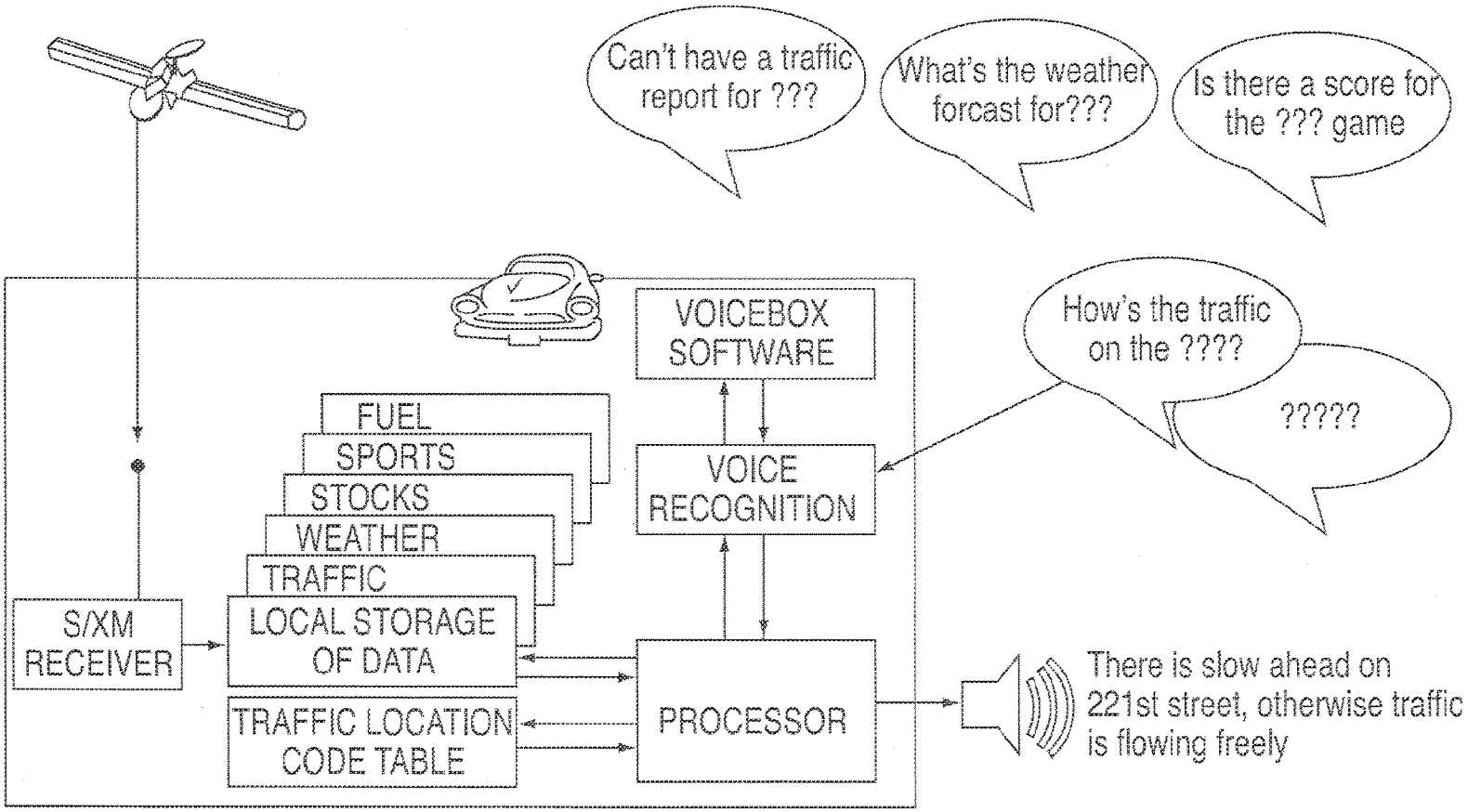
FIG. 13 is a system implementation using voice recognition for retrieval of traffic data or other data according to an exemplary embodiment of the present invention.

FIG. 13 depicts an exemplary implementation of a non-nay traffic data service according to an exemplary embodiment of the present invention. With reference thereto, a customer can ask a question such as "How's the traffic on the 405?"—to which his vehicle can respond with a detailed report of any traffic problems on that highway within a given distance, or can simply state that traffic is flowing freely and there are no incidents to report.

Exemplary Use Cases

1. Which highway should I use?

Jim is headed over to a friend's house and isn't sure whether he should take the I-275 or I-96 highway to get there. He hops into his car and switches to the Traffic view. Noticing that the I-275 highway has several areas of "red" speeds, he elects to take the alternate route to get to his friend's house on time.

2. Avoiding slow speed traffic

Driving down the freeway, you notice that the speed and flow information a few miles ahead of you indicates that traffic is either at stopped or very slow speeds. You know of an alternate route that you can take if you get off at the next exit.

3. Avoiding traffic incidents

About to leave his house, Cameron wants to see if there are any incidents near him that would impact his route to his friend's house. Pressing the "Incidents around You" button, he is shown the incidents around him, sorted by proximity to his current location. Selecting any of the incidents switches the display to the map view so that he can see the traffic congestion that the incident is causing.

4. Pan Around to look for traffic problems.

Looking at a static image of Los Angeles, Jim still has the benefit of seeing the speed/flow and traffic incident data of XM NavTraffic. He can still pan around and see the traffic conditions in the area without having to spend several hundred dollars (or more) for the premium navigation system.

5. Which pre-learned route to take?

James lives about an hour or so from his office and has a number of different options to get to work. In his car, his Non-Nay system has learned 3 different routes that he regularly takes to get to work. When he turns on his car, he presses the "which route should I take" button; his system loads the traffic information for those three routes. The system can show James an overview of the speed and flow data for the three routes and allow him to select the best one. For example, the three routes might be as follows:

| | |
|---|---|
| Route 1 "Drive to work I-696: | 43 minutes |
| Route 2 "Drive to work I-73: | 48 minutes |
| Route 3: "Drive to work I-67: | 54 minutes |

Feature Comparison

The following table summarily presents a feature comparison between exemplary embodiments of the present invention with and without a display screen.

| | Non-Nav Traffic with screen | Non-Nav Traffic without screen |
|---|---|---|
| Supports all current traffic markets | Yes | Yes |
| Supports Incidents and Flow | Yes | Yes |
| Supports future expansion | Yes, if new maps are loaded | Yes, if new phonemes are loaded |
| See your current location on map | Yes | No |
| User can query any market | Yes | Yes |
| User can get info on his current market | Yes | Yes |
| System knows what road you are | No* | No* |
| Supports all other data services | Yes | Yes |

The above-presented description is intended by way of example only and is not intended to limit the present invention in any way except as set forth in the following claims. For example, although embodiments are described with respect to a satellite digital audio radio, the embodiments and contemplated claim scope are equally applicable to other satellite and land based digital audio systems such as broad cast methods HD Radio, DAB, ATSC Mobile, MediaFlo and two way systems such ICO satellite/terrestrial as well as 4G LTE or WiMAX. Furthermore, the embodiments can also be applicable to broadcast as well as two way communication systems. The messaging formats herein are also not limited to TMC, but can include other formats such as TPEG or other proprietary or non-proprietary formats. The decoders used here are not limited to Alert-C decoders, but can be implemented using any other standard or proprietary decoder format. Although the described exemplary embodiments primarily entail head unit applications in vehicles, they can just as easily apply to any electronic device having a screen display (without a navigation system). In exemplary embodiments of the present invention traffic data can be overlaid on roads on a standard map or a representative road system or on custom maps like a subway map.

In other exemplary embodiments, certain TMC location codes can be removed or certain TMC location codes can be added to smooth the colored flow information. In exemplary embodiments of the present invention GPS can be used to automatically show the appropriate map or market or correct data service info.

What is claimed:

1. A system for providing traffic data in a mobile environment, comprising:

a receiver for receiving both digital audio and traffic information sent over a communications link;

a data processor for processing the information;

a location determination mechanism; and a user interface for displaying each of information relevant to the digital audio and the processed traffic information overlaid on at least one geo-referenced image.

2. The system of claim 1, wherein the location determination mechanism comprises at least one of:

a global positioning service receiver, an SDARS receiver, or a cellular receiver.

3. The system of claim 1, wherein the location determination mechanism uses at least one of:

time of arrival, phase of arrival, strength of arrival, frequency of arrival, time difference of arrival, or multiangulation.

4. The system of claim 1, wherein at least one of:

the geo-referenced image comprises a predetermined number of static map tiles, the system uses Traffic Message Channel (TMC) location tables, the data processor is an Alert-C decoder in a head unit, and the receiver is a digital audio radio configured to receive digital streaming traffic data.

5. The system of claim 1, wherein the geo-referenced images comprise one or more tiles of static maps, wherein a user can traverse locations, zoom-in or zoom-out using said tiles of static maps, and wherein the traffic information is correspondingly overlaid over the tiles as they are traversed.

6. The system of claim 5, wherein the user can select alternate traffic markets from a drop down menu using speech recognition, or other user friendly input method.

7. The system of claim 1, wherein at least one of:

(i) the system is integrated with a radio head unit in a vehicle, and (ii) the system further comprises a back channel to provided additional traffic data to the system from the receiver.

8. The system of claim 1, wherein the geo-referenced image comprises a predetermined number of static maps, wherein traffic information corresponding to a current location is overlaid at least over a portion of the static maps such that road network and names are overlaid accurately and in a manner where labels remain visible.

9. The system of claim 1, wherein at least one of:

(i) information from multiple adjacent traffic markets is displayed on a single screen, and (ii) the display, traffic information, and traffic maps support day and night coloring.

10. The system of claim 1, wherein the geo-referenced image comprises a base map that is tiled and traversed by tile automatically in a direction corresponding to the direction of movement detected by the location determination mechanism in a zoomed in configuration.

11. The system of claim 1, wherein the user interface supports a split screen view wherein a first portion of the screen displays traffic information overlaid over a map and a second portion of the screen displays music or other auxiliary data.

12. The system of claim 1, wherein the at least one geo-referenced image is one of stored in the receiver, or received over the communications link.

13. The system of claim 1, wherein the at least one geo-referenced image is a limited functionality image or picture of a city or regional road network.

14. The system of claim 1, wherein the traffic information uses Traffic Message Channel (TMC) Location Codes and wherein the system further includes a TMC location code lookup table to convert the TMC location codes back into a latitude and longitudes for display on the at least one geo-referenced image.

15. The system of claim 1, wherein, at least one of:

(i) the system generates stylized color coded maps using straight lines for each market representative of roads being traversed, and (ii) the system generates stylized color coded maps using straight lines for each market representative of roads being traversed, and the maps have individual TMC traffic location tables that can identify the road segments visible in each map image.

16. The system of claim 1, wherein at least one of:

(i) the traffic information can be overlaid on each image using such a custom location code database; and (ii) the geo-referenced images are referenced with latitude/longitude information.

17. A method for providing a traffic data service in a mobile environment through a digital audio receiver, comprising:

receiving at a mobile digital audio receiver traffic information sent over a communications link;

determining a current location of the mobile radio receiver receiving the traffic information; and overlaying traffic information corresponding to the current location over at least a portion of a plurality of geo-referenced images and displaying said information on a display also used to display information relevant to digital audio.

18. The method of claim 17, wherein the current location is determined using at least one of:

a global positioning service receiver, a SDARS receiver, or a cellular receiver, using one or more of:

time of arrival, phase of arrival, strength of arrival, frequency of arrival, time difference of arrival, multiangulation, or any combination thereof.

19. The method of claim 17, wherein:

each of the plurality of geo-referenced images was either provided in the receiver when manufactured, or received at the receiver over the communications link, and at least one of:

(i) the geo-referenced images comprise one or more tiles of static maps, a user can traverse locations, zoom-in or zoom-out using said tiles of static maps, and wherein the traffic information is correspondingly overlaid over the tiles as they are traversed, (ii) the geo-referenced image comprises a predetermined number of static maps, wherein traffic information corresponding to a current location is overlaid at least over a portion of the static maps such that road network and names are overlaid accurately and in a manner where labels remain visible, (iii) the traffic information can be overlaid on each geo-referenced image using such a custom location code database; and (iv) the geo-referenced images are referenced with latitude/longitude information.

20. A non-transitory computer readable medium containing instructions that, when executed by at least one processor of a computing device, cause the computing device to:

receive, at a digital audio receiver comprising a computing device, traffic information sent over a communications link;

process the traffic information;

determine a current location of the computing device; and display, on a user interface communicably connected to the digital audio receiver, the processed traffic information overlaid on at least one geo-referenced image, wherein said user interface is also used to display information relevant to received or played digital audio at the receiver.

* * * * *